United States Patent [19]

Nelson

[11] 4,347,102

[45] Aug. 31, 1982

[54] ELIMINATION OF POTASSIUM COMPOUNDS FROM SODIUM-BASED PULPED CYCLES

[75] Inventor: Hugh W. Nelson, West Hartford, Conn.

[73] Assignee: Combustion Engineering, Inc., Windsor, Conn.

[21] Appl. No.: 250,346

[22] Filed: Apr. 2, 1981

[51] Int. Cl.[3] ..... D21C 11/12

[52] U.S. Cl. ..... 162/35; 162/36; 162/80; 162/190; 210/928

[58] Field of Search ..... 162/30.1, 30.11, 31–33, 162/35–38, 79, 80, 189–191; 210/721, 737, 761, 769, 928

[56] References Cited

U.S. PATENT DOCUMENTS

| | | | |
|---|---|---|---|
| 2,592,907 | 4/1952 | Kahn | 162/38 |
| 3,617,434 | 11/1971 | Nakafuri et al. | 162/35 X |
| 4,053,352 | 10/1977 | Hultman | 210/928 X |
| 4,098,639 | 7/1978 | Norens et al. | 162/35 X |
| 4,237,103 | 12/1980 | Prible | 162/31 X |

*Primary Examiner*—Thomas G. Wyse

*Attorney, Agent, or Firm*—Arthur L. Wade

[57] ABSTRACT

The potassium compounds in heavy black liquor flowing in the recovery cycle are reduced by the introduction of magnesium nesosilicate to form magnesium potassium silicate which is voided from the system by filtration.

3 Claims, No Drawings

ELIMINATION OF POTASSIUM COMPOUNDS FROM SODIUM-BASED PULPED CYCLES

TECHNICAL FIELD

This invention relates to reducing the potassium content of sodium-based pulping cycles to avoid sulfur depletion of the chemical recovery cycle and to decrease furnace tube metal corrosion by the smelt. More particularly, the invention relates to forming an insoluble reaction product with potassium so the potassium may be mechanically voided from the pulping cycle.

BACKGROUND ART

Several processes for pulp making utilize liquid streams with a high content of caustic compounds to dissolve lignin and free the cellulose fibers of wood. Not only are sodium sulfide and sodium hydroxide useful for dissolving lignin, but any analogous potassium compounds available in the pulping cycle may act in the same manner. However, the potassium compounds become a problem when they pass into the recovery cycle in the spent liquor stream.

Consider the pulping and recovery cycles at the exit from the chemical recovery furnace. Green liquor is formed by dissolving the molten smelt discharged from the furnace into the water of the dissolving tank. Green liquor is causticized to form the working white liquor. In the digester, wood chips are heated under pressure in the white liquor to dissolve the lignin. The weak black liquor from the digester has its water content decreased by evaporation. The resulting heavy black liquor is then conducted to the chemical recovery furnace.

Potassium compounds from the wood are inadvertently added to the weak black liquor in the digester during the process of dissolving the lignin. Recovery of chemical values from mill waste streams added to the black liquor, and the impurities contained in the makeup materials, also add potassium compounds to the black liquor. Therefore, the potassium content of the heavy black liquor stream fed to the chemical recovery furnace comes from several sources. In any event, the potassium compounds in the heavy black liquor continue to build up in the recovery system and create the problems in the chemical recovery furnace which are solved by the present invention.

The heavy black liquor is fed into the chemical recovery furnace where most of the water content of the liquor is flashed into steam, the organic content is pyrolized and burned, and the inorganics are formed into a molten smelt. With the inorganics reduced to a molten smelt, the final step is the fragmenting of this smelt with steam to further the dissolving of the inorganics in an aqueous phase to form green liquor. As previously stated, this green liquor is causticized, its alkali content raised, to form the working white liquor for the digester.

Again, the problem faced by the present invention is created by the potassium content of the heavy black liquor fed into the chemical recovery furnace. It is the practice to form a spray of the black liquor over the burning bed of char so that the water of the heavy black liquor will be largely flashed into vapor and be ejected from the furnace. The temperature of the bed is expected to be maintained at 1600°-1800° F. However, potassium compounds lower the melting point of ash in the bed which, in turn, lowers the bed burning temperature substantially. Unfortunately, this lower bed temperature in the reducing atmosphere maintained in the furnace breaks down the sodium sulfide to form hydrogen sulfide which is burned to sulfur dioxide and, thus, is lost up the furnace stack along with the other vapors of combustion. In addition, the lower melting smelt contaminated by potassium compounds is much more corrosive to the metalic furnace tubes. Therefore, what is needed is an additive to the heavy black liquor stream, on its way to the chemical furnace, which will form a high melting, insoluble reaction product with the potassium to prevent the lowering of the furnace bed and smelt-melting temperatures.

DECLARATION OF THE INVENTION

The present invention contemplates the addition of magnesium nesosilicate to black liquor containing potassium compounds prior to injection of the heavy black liquor into the chemical recovery furnace of a pulp-making cycle to form magnesium potassium silicate as a high-melting, insoluble reaction product which can be subsequently voided from the recovery cycle.

The invention further contemplates the addition of at least a stoichiometric amount of magnesium nesosilicate to the potassium-containing black liquor stream, to the end that the subsequent formation of the magnesium potassium silicate will obviate lowering of the bed temperature in the recovery phase with subsequent loss of sulfur as sulfur dioxide, and increased corrosive attack of furnace tubes.

Other objects, advantages and features of this invention will become apparent to one skilled in the art upon consideration of the written specification, and appended claims.

NO DRAWING IS SUBMITTED

BEST MODE FOR CARRYING OUT THE INVENTION

The problem in the recovery cycle, processing heavy black liquor, was broadly outlined as descending upon the increase of potassium compounds. These potassium compounds offer no problem in the pulping cycle. As a matter of fact, some potassium compounds may be expected to result from dissolving lignin from the cellulose fibers. Other sources of potassium may come from potassium-contaminated chemicals added to the black liquor as chemical makeup. Still additional potassium may come from waste chemical streams added to the black liquor to recover certain chemical values. Whatever the source, potassium compounds lower the bed temperature in the chemical recovery furnace and cause the sodium sulfide to react in the reducing atmosphere of the chemical recovery furnace and release sulfur in the form of hydrogen sulfide. The lower smelt melting point also makes the smelt more corrosive to metal. These unfortunate conditions are a result of the potassium compounds in the chemical recovery furnace forming a low-melting ash which lowers the bed temperature below the desired 1600°-1800° F. range, and the smelt melting point below its normal level, approximately 1500° F.

The prior art offers no solution to obviate the effects of potassium on the chemical recovery furnace temperature and smelt melting point. The present invention, once the background is fully appreciated, has a simple solution to this problem. Fortunately, there is an additive found in the mineral Olivine which will bind the potassium compounds to form a high-melting, insoluble reaction product without reacting with the sodium compounds present. As this reaction product is relatively water insoluble, it can subsequently be eliminated from the dissolving tank into which the molten smelt is flowed. Along with other solid residues termed "dregs", this potassium-containing compound can be voided from the system.

Olivine, fortunately, is found in large and inexpensive quantities. This naturally occurring siliceous mineral contains principally iron and magnesium silicates in accordance with the following formula: $(Mg,Fe)_2 Sio_4$ or $Mg_2SiO_4.Fe_2SiO_4$. Potassium will react at bed temperatures within the recovery furnace with magnesium nesosilicate (Forsterite) to "fix" the potassium as a non-volatile heat stable reaction product according to the following equation:

$$Mg_2SiO_4 + K_2O \rightarrow MgK_2SiO_4 + MgO$$

In overlap with preceding descriptions, the molten smelt drawn from the furnace, along with the magnesium potassium silicate, is shattered by steam and dropped into the water of the dissolving tank. Mechanical filters are provided to remove any insoluble compounds from the green liquor. Most of the magnesium potassium silicate is thereby swept up with the other insoluble debris of the green liquor and voided from the pulping cycle.

From the foregoing, it will be seen that this invention is one well adapted to attain all of the ends and objects hereinabove set forth, together with other advantages which are obvious and inherent to the method.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth is to be interpreted in an illustrative and not in a limiting sense.

I claim:

1. In a pulping and recovery cycle where heavy black liquor including potassium compounds is passed into a chemical recovery furnace to form a smelt of inorganic material from the heavy black liquor, passing magnesium nesosilicate into the black liquor prior to its introduction into furnace, whereby the potassium and magnesium nesosilicate combine in the furnace bed to form magnesium potassium silicate as a high-melting insoluble reaction product.

2. The system of claim 1 wherein, the magnesium nesosilicate is added to the potassium in the heavy black liquor in at least a stoichiometric quantity.

3. The system of claim 1, in which, the magnesium nesosilicate is added to the heavy black liquor in the form of Olivine.

* * * * *